US008480090B1

(12) United States Patent
Lemberg et al.

(10) Patent No.: US 8,480,090 B1
(45) Date of Patent: Jul. 9, 2013

(54) POKER GAME USING TWO CARD HANDS

(76) Inventors: Steven J. Lemberg, Bloomfield Hills, MI (US); Joseph E. Lemberg, Bloomfield Hills, MI (US)

( * ) Notice: Subject to any disclaimer, the term of this patent is extended or adjusted under 35 U.S.C. 154(b) by 39 days.

(21) Appl. No.: 12/910,709

(22) Filed: Oct. 22, 2010

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS

| | | | | |
|---|---|---|---|---|
| 5,415,414 | A * | 5/1995 | Savage | 273/306 |
| 5,465,975 | A * | 11/1995 | Shull et al. | 273/295 |
| 5,605,333 | A * | 2/1997 | Field | 273/274 |
| 6,029,976 | A * | 2/2000 | Brunelle | 273/309 |
| 6,189,888 | B1 * | 2/2001 | Brunelle | 273/292 |
| 6,332,614 | B1 * | 12/2001 | Hesse | 273/292 |
| 6,390,474 | B1 * | 5/2002 | Terminel et al. | 273/292 |
| 6,840,517 | B2 * | 1/2005 | Snow et al. | 273/292 |
| 6,869,075 | B1 * | 3/2005 | Stavinsky | 273/292 |
| 6,986,514 | B2 * | 1/2006 | Snow | 273/292 |
| 7,387,300 | B2 * | 6/2008 | Snow | 273/292 |
| 7,407,163 | B2 * | 8/2008 | Snow | 273/292 |
| 2004/0041346 | A1 * | 3/2004 | Snow | 273/292 |

OTHER PUBLICATIONS http://www.google.com/search?q=blackjack+side+wager+with+predetermined+point+total.*

* cited by examiner

*Primary Examiner* — Kurt Fernstrom
*Assistant Examiner* — Dolores Collins
(74) *Attorney, Agent, or Firm* — Muskin & Cusick LLC

(57) ABSTRACT

A method, apparatus, and computer readable storage to implement a casino wagering game using two card poker hands. The player can make two wagers, a high card ante wager and a straights and flushes side wager. The player is dealt two cards and the dealer is dealt three cards comprising an upcard, a downcard and a swap-card. The player can raise or fold. The dealer will then use the upcard and either the downcard or the swap-card, whichever creates the better hand for the dealer. The player's wagers are resolved based on a relationship between the player's hand and the dealer's hand.

18 Claims, 4 Drawing Sheets

POKER GAME USING TWO CARD HANDS

BACKGROUND OF THE INVENTION

1. Field of the Invention

The present inventive concept relates to a wagering game intended for use in casinos.

2. Description of the Related Art

Casino poker is a well known casino wagering game. Players tend to grow bored with the same games over and over, thus what is needed is a new and exciting variation of poker that players will find enjoyable and that casinos will find profitable.

SUMMARY OF THE INVENTION

It is an aspect of the present invention to provide an exciting casino wagering game relating to poker.

The above aspects can be obtained by (a) providing a physical deck(s) of cards; receiving an ante wager from a player; dealing a player's hand to the player using two cards; dealing to a dealer a dealer's initial hand comprising an up-card, a down-card, and a swap-card, wherein a down hand comprises the up-card and the down-card and a swap hand comprises the up-card and the swap-card; determining a dealer's hand by using a higher ranking hand between the down hand and the swap hand; and resolving the ante wager based on a relationship between the player's hand and the dealer's hand.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
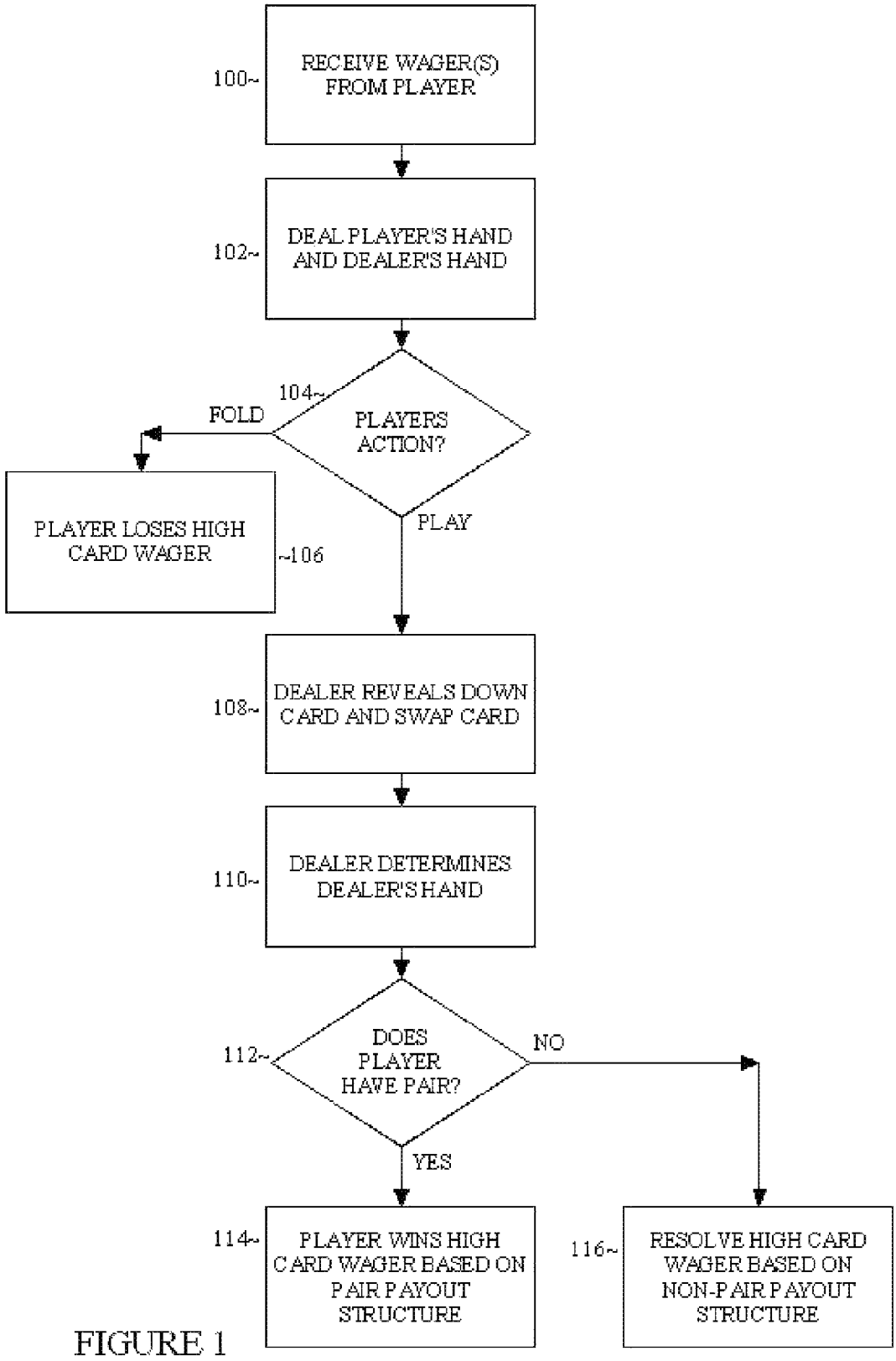
FIG. 1 is a flowchart illustrating a method to implement a high card bet, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer a poker game involving two card hands. The player can make two independent bets, a high card ante bet and a straights and flushes side bet. The dealer is dealt three cards, an up-card, a down-card and a swap-card (face down). The player can then raise (by placing a play wager) or fold. The dealer then reveals his or her cards and uses his or her up-card and either the down-card or the swap-card, whichever makes the better dealer's hand. The ante wager and play wager are resolved based on the ranking and relationship between the player's hand and the dealer's hand. The straights and flushes side bet is resolved based on the ranking of the player's hand and also a relationship between the player's hand and the dealer's hand.

FIG. 1 is a flowchart illustrating a method to implement a high card bet, according to an embodiment. In the high card bet, the player is competing against the dealer.

The method can begin with operation 100, which receives wager(s) from the player. The players place their wagers by placing the respective wagers (in the form of chips) into a respective betting circle The wager(s) can be a "high card" ante bet and a "straights and flushes" side bet. The player can choose to make either, or both, of these two wagers. Each of these two bets is resolved independent of the other. Additional side wagers (not described herein) can also be offered to the player.

The method proceeds to operation 102, wherein a dealer deals the player's hand and the dealer's hand. The player's hand contains two cards (either face up or face down but viewable by the player). The dealer's hand contains three cards: an up-card (face up), a down-card (face down), and a swap card (face down).

From operation 102, the method proceeds to operation 104, wherein the player (after viewing his or her hand) takes his or her choice of action, either fold or play. If the player wishes to fold, then the method proceeds to operation 106, wherein the player loses his or her high wager (e.g., it is taken by the dealer/house) and the resolution of the high card wager ends.

If the player in operation 104, wishes to play, then the player must place a raise wager equal to the ante bet placed in operation 100. In an alternative embodiment, the raise wager does not have to be equal in amount to the ante bet. The method then proceeds to operation 108, wherein the dealer reveals the dealer's down card and swap card.

From operation 108, the method proceeds to operation 110, wherein the dealer determines the dealer's two card hand out of the three dealer cards dealt in operation 102. Initially, the dealer's hand is formed using the dealer's up card and dealer's down card. If the hand formed using the up card and the swap card ranks higher than the hand formed using the up card and the down card, then the dealer's hand now becomes the up card and the swap card. In other words, the dealer must always use the up card and then either uses the down card or the swap card, whichever results in the dealer's better two card hand. If the down card and the swap card are of the same rank, then the down card is used. The hand ranking to determine which card to use is based on the rules in the following paragraph. All player's at the table are shown which cards are used to form the dealer's hand.

From operation 110, the method proceeds to operation 112, which determines whether the player has a pair. The ranks of hands can also be determined at this point. For the high card bet, two card hands can be ranked as follows. The pairs AA, KK, . . . 33, 22 are ranked in normal poker order, with AA the high pair and 22 the low pair. A higher pair beats a lower pair. Pairs of the same rank push. A pair ranks higher than a non-pair. The remaining hands are ranked in their normal poker order by high card rank then low card rank. There are no flushes or straights. Thus, the highest remaining hand is AK. The pair 22 beats AK. Two hands in this category are evaluated against each other by comparing the ranks of their highest ranked card first. The hand with the higher ranked top card wins. If the two hands contain the same rank for the high card, then the rank of the second card is used to determine the highest hand.

If in operation 112 it is determined that the player has a pair, then the method proceeds to operation 114 which resolves the ante and play wagers based on a pair payout structure such as that illustrated in Table I. For example, if the player's hand ranks higher than the dealer's hand, then the ante and play wager are both paid at 3:2. If the player's hand ties the dealer's hand, then the ante and play wager are both paid at 3:1. If the player's hand ranks lower than the dealer's hand (i.e. the dealer's hand ranks higher than the player's hand) then the ante and play wager are both paid at 3:1. Note that the player has a pair yet still loses, thus entitling the player to a relatively large payout of 3:1 which could be considered a "bad beat" (where the player has a good hand but does not outrank the dealer). Of course it can be appreciated that other payout structures other than those illustrated in Table I can be used as well.

TABLE I

| condition | ante & play wagers |
|---|---|
| Player's hand > dealer's hand | 3:2 |
| Player's hand ties dealer's hand | 3:1 |
| Player's hand < dealer's hand | 3:1 |

If in operation 112 it is determined that the player does not have a pair, then the method proceeds to operation 116, which resolves the ante and the play wager based on a non-pair payout structure such as that illustrated in Table II. For example, if the player's hand ranks higher than the dealer's hand, then the ante and play wager are each paid at 1:1 (even money). If the player's hand ties the dealer's hand then the ante and the play wager push (do not win or lose). If the player's hand ranks lower than the dealer's hand then the ante and the play wagers both lose (are taken by the dealer/house). Of course, it can be appreciated that other payout structures other than those illustrated in Table II can be used as well.

TABLE II

| condition | ante & play wagers |
|---|---|
| player's hand > dealer's hand | 1:1 |
| player's hand ties dealer's hand | push |
| player's hand < dealer's hand | lose |

It can be appreciated that the operations in FIG. 1 (and FIG. 2 as well) can be performed in any sensible order. It is also appreciated that there would exist an optimal strategy for the high card bet (ante and raise) for the player to follow that would maximize the player's return. The player's strategy comprises whether the player should raise or fold based on the cards revealed (i.e. the player's two cards and the dealer's upcard). Table III below illustrates the optimal strategy for the high card bet (ante and raise) played as described herein using six standard decks of playing cards without jokers. Of course, each player can play using whatever strategy they prefer and do not have to follow the optimal strategy.

TABLE III

| Player hand, high card | Player hand, low card | Dealer up card | Strategy |
|---|---|---|---|
| any | equal to player's high card (pair) | any | play |
| any | lower than player's high card | higher than player's high card | fold |
| ten or higher | lower than player's card | high lower than player's high card | play |
| ten or higher | 8 or higher | same as player's high card | play |
| ten or higher | 7 or lower | same as player's high card | fold |
| nine high | 7 or lower | equal or lower than player's low card | play |
| nine high | 7 or lower | higher than player's low card | fold |
| nine high | 8 | 9 or lower | play |
| eight high or lower | Lower than player's high card | any | fold |

Figure 2:
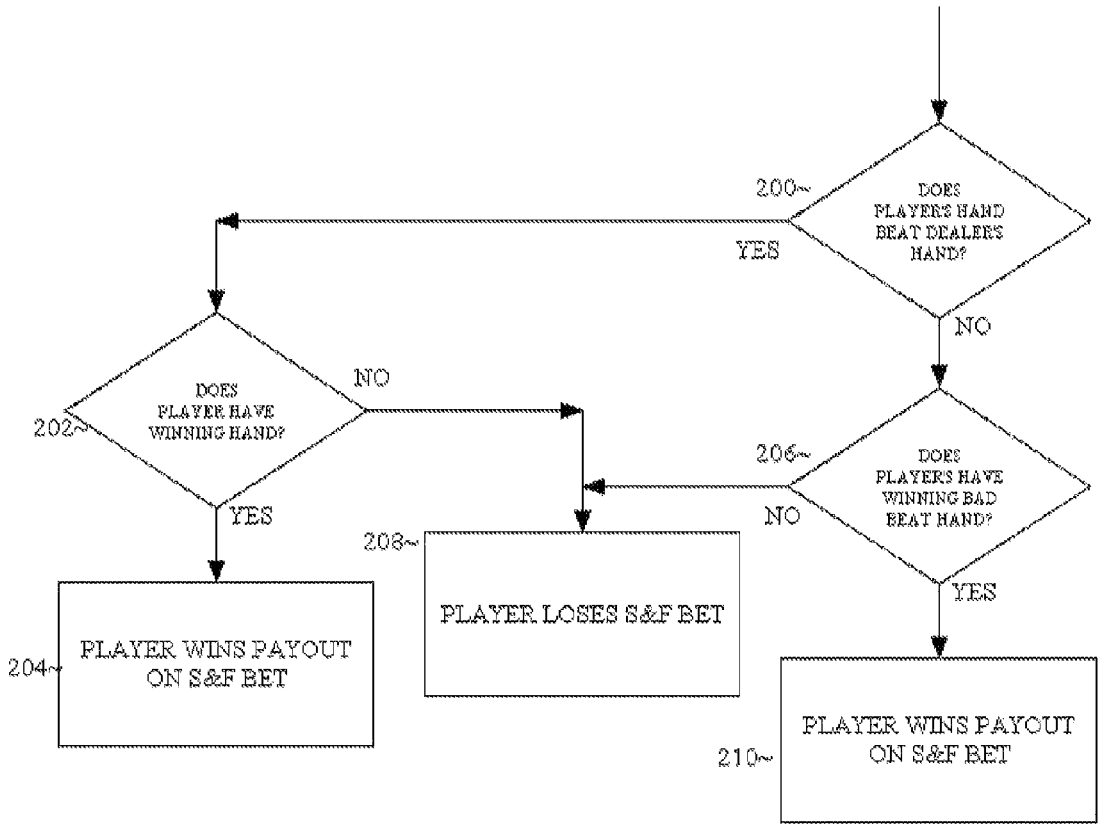
FIG. 2 is a flowchart illustrating a method to implement a straights and flushes bet, according to an embodiment.

FIG. 2 is a flowchart illustrating a method to implement a straights and flushes bet, according to an embodiment. Operations 200-210 are conducted after operation 110 in FIG. 1, either sequentially or simultaneously with operations 104-116. It is noted that the straights and flushes bet and the high card bet are two separate bets and can be resolved in any sequence. The dealer's two card hand needs to be determined (in operation 110) before operation 200 is performed. It is noted that the dealer uses the card which results in the better high card ranking (straights and flushes do not matter). However, it may be possible that the dealer could have a straight or flush using the up-card and the down-card, and according to the dealer rules the dealer may have to use the swap-card which would "bust" the straight or flush. For example, if the dealer's up-card is a 9-diamonds, the dealer's down-card is a 10-diamonds, and the dealer's swap-card is a 9-hearts. The dealer would have a straight flush using the up-card and the down-card, however according to the dealer rules the dealer must use the swap-card because it makes a pair, thus "busting" the dealer's straight flush. This could have an effect on the player's straights and flushes (side) bet, by allowing the player to win the straights and flushes side bet in spite of the dealer up card and down card making a better straight or flush hand than the player's hand.

In operation 200, it is determined whether the player's two card hand beats the dealer's two card hand (after determining whether or not to use the dealer's swap card in operation 110).

The two card hand rankings are illustrated in Table IV below, which shows hands ranked from best to worst.

TABLE IV

| |
|---|
| paired flush - two cards of the same rank and same suit. These hands are ranked in normal poker order, with AA (suited) the high paired flush, and 22 (suited) the low paired flush. |
| straight flush - two cards of the same suit that have consecutive ranks. An Ace can act as both a high and low card. These hands are ranked in normal poker order, with AK (suited) the high straight flush, and A2 (suited) the low straight flush. |
| straight - two cards of different suits that have consecutive ranks. An Ace can act as both a high and low card. These hands are ranked in normal poker order, with AK (unsuited) the high straight, and A2 (unsuited) the low straight. |
| flush - two cards of the same suit, such that the hand is neither a paired flush nor a straight flush. That is, the rank of the two cards must differ by 2 or more. For a flush, an Ace is always treated as a high card. These hands are ranked in normal poker order; with AQ (suited) the high flush and 24 (suited) the low flush. |

All other hands are not ranked and are losing hands for the Straights and Flushes bet. If two hands are in different categories, the hand in the higher ranked category wins. Two hands in the same category are evaluated against each other by comparing the ranks of their highest ranked card first. The hand with the higher ranked top card wins. If the two hands contain the same rank for the high card, then the rank of the second card determines the best hand. If the ranks of both cards match, then the hand is a push (except for bad beats).

If it is determined (in operation 200) that the player's hand does beat the dealer's hand, then the method proceeds to operation 202, which determines whether the player has a winning hand according to a straights and flushes paytable, such as that illustrated in Table V (but not including the first two bad beat payouts). If the player does not have one of the bottom four hands in Table V (paired flush, straight flush, straight, flush) then the method proceeds to operation 208, wherein the player loses the straights and flushes bet. Table V illustrates ten possible paytables, the casino would choose which of the ten it prefers to use.

TABLE V

| event | Pay #1 | Pay #2 | Pay #3 | Pay #4 | Pay #5 | Pay #6 | Pay #7 | Pay #8 | Pay #9 | Pay #10 |
|---|---|---|---|---|---|---|---|---|---|---|
| bad beat paired flush | 75 | 100 | 150 | 100 | 75 | 75 | 50 | 100 | 75 | 50 |
| bad beat straight flush | 25 | 20 | 20 | 25 | 20 | 25 | 20 | 20 | 20 | 20 |
| paired flush | 8 | 8 | 7 | 7 | 8 | 7 | 8 | 7 | 7 | 7 |
| straight flush | 4 | 4 | 4 | 4 | 4 | 4 | 4 | 4 | 4 | 4 |
| straight | 2 | 2 | 2 | 2 | 2 | 2 | 2 | 2 | 2 | 2 |
| flush | 1 | 1 | 1 | 1 | 1 | 1 | 1 | 1 | 1 | 1 |

If in operation 202 it is determined that the player has one of the winning bottom four hands in Table V (paired flush, straight flush, straight, flush), then the method proceeds to operation 204, wherein the player wins the respective payout on the straights and flushes bet. Table V shows 10 sample paytables for the straights and flushes bet, although of course it can be appreciated that other paytables (both winning combinations and their respective payouts) can be used as well. It is noted that in FIG. 2 and Table V, if the player does not have a straight or a flush then the player would always lose.

If in operation 200, it is determined that the player's hand does not beat the dealer's hand, then the method proceeds to operation 206, which determines whether the player has a winning bad beat hand (one of the first two hands in Table IV). If the player's hand is not a paired flush or a straight flush, then the method proceeds to operation 208, wherein the player loses the straights and flushes bet.

If in operation 206 it is determined that the player's hand is a winning bad beat hand (a paired flush or a straight flush), then the method proceeds to operation 210, wherein the player wins the respective payout on the straights and flushes bet.

An alternate logic flow can be used instead of what is shown in FIG. 2 (with equivalent results). A first operation can be performed to check if the player has a potential winning hand on the paytable. If not, the player loses the straights and flushes (side) bet and the method ends. If yes, then a second operation is performed that determines whether the player hand beats (ranks higher than) the dealer's hand. If yes, then the player wins a payout on the paytable. If not, then a third operation is performed that determines whether the player has a winning bad beat hand. If so, then the player wins the respective bad beat payout on the paytable, otherwise the player loses the straights and flushes side bet.

In a further embodiment, the straights and flushes bet can be resolved simply against a paytable without regard to whether the player's hand beats the dealer's hand. It is also noted that the straights and flushes bet is called "straights and flushes," this bet can be implemented using additional hands in addition to straights and flushes as well as not using straights and/or flushes as winning hands.

Figure 3A:
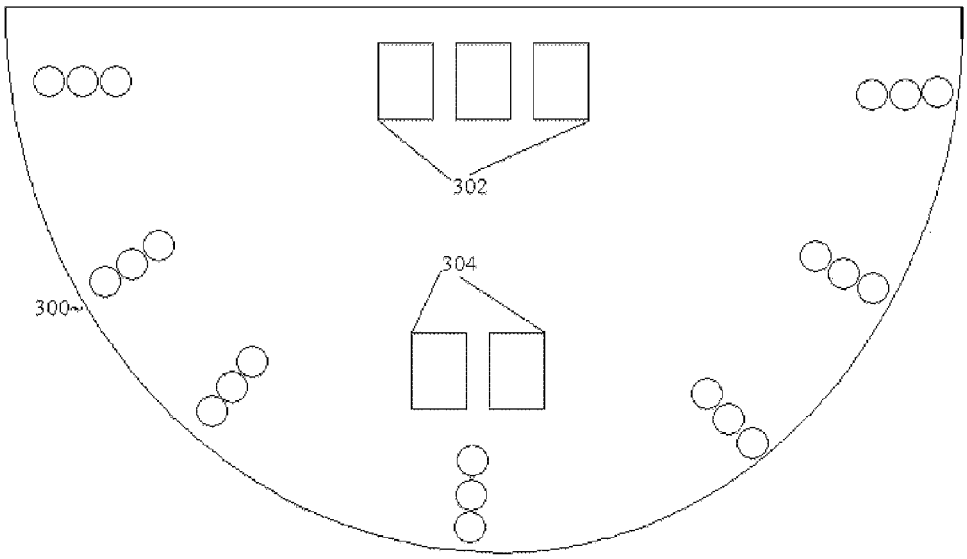
FIG. 3A is a drawing of an exemplary table layout used to implement the methods described herein.

FIG. 3A is a drawing of an exemplary table layout used to implement the methods described herein. Such a layout is used with the physical casino version of the game used in a live casino using physical cards, a physical gaming table, and physical chips to make/resolve wagers.

A physical gaming table 300 is used to play the game. A dealer's initial three cards (the upcard, downcard, and swap card) 302 and the player's two card hand 304 is shown. The Table 300 pictures accommodates seven simultaneous players, although of course other numbers of players can be accommodated as well. Of course, not all seven players need be playing at the same time.

Figure 3B:
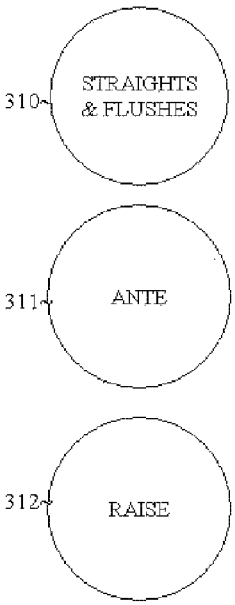
FIG. 3B is a drawing of an individual betting circle arrangement used to implement the methods described herein, according to an embodiment.

FIG. 3B is a drawing of an individual betting circle arrangement used to implement the methods described herein, according to an embodiment. The table 300 illustrated in FIG. 3A incorporates seven such arrangements.

An ante betting circle 311 is used to receive the high card ante wager. A raise wager betting circle 312 is used to receive the raise wager. A straights and flushes wager betting circle 310 is used to receive the straights and flushes wager.

Figure 3C:
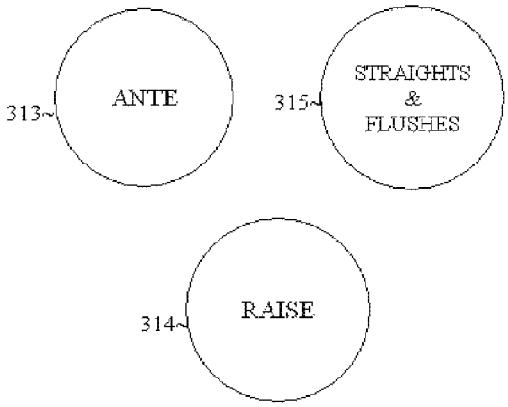
FIG. 3C is a drawing of another individual betting circle arrangement use to implement the methods described herein, according to an embodiment.

FIG. 3C is a drawing of another individual betting circle arrangement use to implement the methods described herein, according to an embodiment. An ante wager betting circle 313, a raise wager betting circle 314, and a straights and flushes wager betting circle 315 are shown.

An example of the game will now be presented. Joe places a $1 ante wager and a $1 side (straights and flushes) wager.

The dealer deals Joe a king-spades and 10-hearts. The dealer also deals the dealer an upcard of 5-spades, a downcard (face down) and a swap card (face down). Joe decides to raise by placing a $1 raise wager. The dealer now reveals the downcard to be a 9-diamonds and the swap card to be a 2-clubs. The dealer determines that the best dealer's hand (using the upcard) would be formed using the downcard (not the swap card) because the downcard has a higher rank (and neither card forms a pair with the up-card). So the dealer's final hand would be 5-spades/9-diamonds. Joe's hand is king-spades/10-hearts. Joe's hand has a higher rank (king) and thus Joe has the higher hand. Since the player does not have a pair, Table II is used and according to that paytable since Joe has a higher ranking hand than the dealer, Joe wins an even money payout on both the ante and the raise wager. Thus Joe wins a $1 payout on the ante wager and a $1 payout on the raise wager. Regarding the side wager, Joe has won the ante/raise wager (has a higher ranking hand than the dealer) and thus the side wager pays on a predetermined set of hands (the bottom four ranks in Table V). Since Joe does not have a straight or a flush, Joe loses the side wager. Thus, Joe has wagered $3 of his own money (ante, raise, side), won $2 in payouts (ante, rise), and lost $1 (side), Joe now has $4 in chips on the table he can keep for an overall profit of $1.

Another example will now be presented. Jane bets $1 on the ante wager and $1 on the side wager. The dealer deals Jane a 5-hearts/5-spades. The dealer deals an up-card of 9-spades (face up) and a downcard (face down) and a swap card (face down). Jane decides to raise and places a $1 raise wager. The dealer now reveals the dealer's downcard to be king-hearts and the swap card to be a 9-clubs. The dealer determines his best hand using the upcard (9-spades) and either the downcard (king-hearts) or the swap card (9-clubs). Since the upcard and the swap-card give the dealer a pair of 9's (which ranks higher than a king-high rank using the downcard) the dealer uses the swapcard to form the dealer's two card hand. The dealer can indicate which card he is using (the downcard or the swapcard) by putting the dealer's two card hand together (the up-card and the other required card) and discarding the unused card (or putting it aside). Thus, the dealer would put the 9-spades and the 9-clubs together. Since Jane has a pair, the pair payout structure of Table I, wherein since the player's rank of a pair of 5's is lower than the dealer's rank of a pair of 9's, the player wins a 3:1 payout on both the ante wager and the raise wager ($3 each or a total of $6). Regarding the side wager, since the player hand rank does not beat the dealer hand, it is determined (in operation 206) whether the player has a winning bad beat hand. According to Table V, there are two winning bad beat hands, a paired flush and a straight flush. Since Jane's hand of 5-hearts/5-spades is not a paired flush (a paired flush would require a pair of the same suit), then Jane does not have a winning bad beat hand and would lose the side wager. Thus, Jane has wagered $3 of her own money, won a payout of $6 and lose $1, leaving $8 in chips on the table for her to take (giving her a profit of $5).

Figure 4:
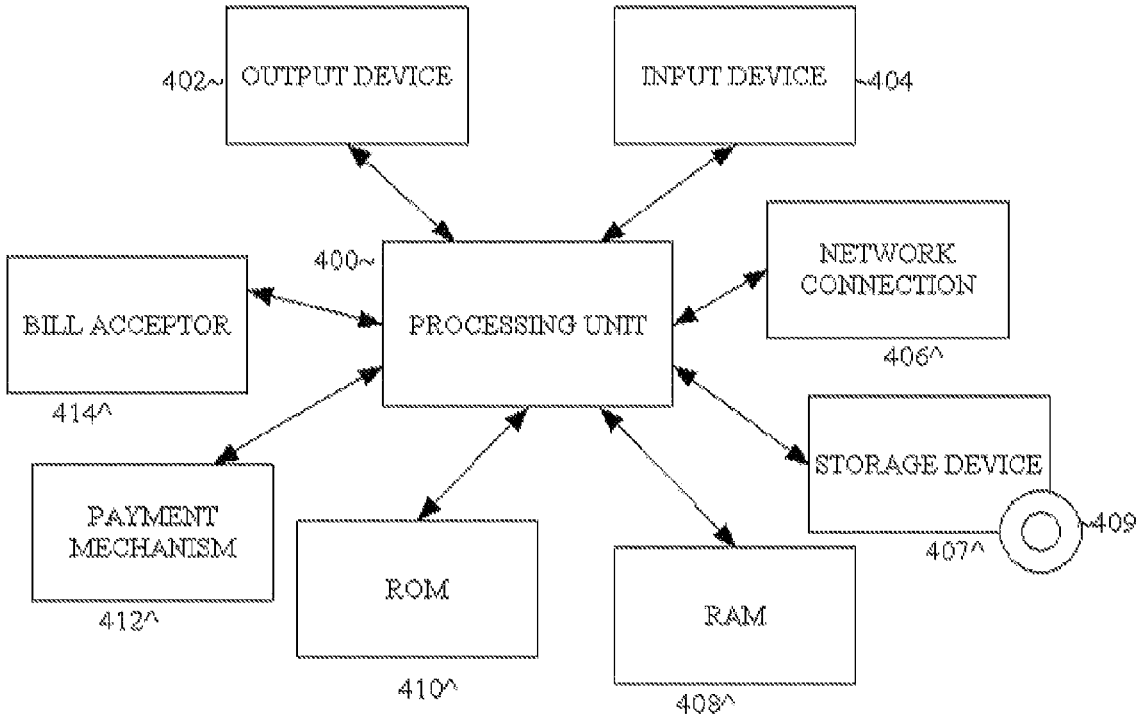
FIG. 4 is a block diagram of hardware that can be used to implement an electronic version of the invention, according to an embodiment.

FIG. 4 is a block diagram of hardware that can be used to implement an electronic version of the invention, according to an embodiment.

A processing unit 400 (such as a microprocessor and associated apparatus such as bus, cache, etc.) can be connected to an output device 402 (such as an LCD screen, touch-screen, speaker, etc.) and an input device 404 (such as a touch-screen, keyboard, mouse, buttons, etc.) The processing unit 400 can also be connected to a network connection 406 (such as an LAN, WAN, wifi, Internet, etc.) The processing unit 400 can also be connected to a RAM 408 and a ROM 410 and a bill acceptor 414 (which can also accept cashless vouchers or funds via electronic deposit). The processing unit 400 can also be connected to a payment mechanism 412 which can make payment to the player of any winnings (either in physical coins, cash, cashless ticket, or electronic funds transfer). Funds can be deposited (via bill acceptor 414) which can then be converted to playable credits which is used by the player to make his or her wagers. When the player desires to cash out the playable credits, the credits can then be converted to a cash amount which his then issued via the payment mechanism 412.

The processing unit 600 can also be connected to a storage device 407 (e.g., hard disk, CD-ROM, DVD-drive, BLU-RAY, EPROM, etc.) which can read an appropriate computer readable storage medium 409 (such as a CD-ROM, etc.) that stores a program that controls the processing unit 400 to implement the methods described herein.

Also not pictured is a player tracking apparatus that can be used to track player's play at a physical gaming table. Such a system is described in U.S. Pat. No. 5,836,817, which is incorporated by reference herein in its entirety. The gaming table contains a magnetic (or other encoding) card reader that can read a player's players card. When a player sits down to play at a table, the dealer can swipe the player's card through electronic card reader, which information about the player's identify is thereafter transmitted to a casino electronic database so that the player's wagering activity can be tracked. Thus, when the player places higher wagers in the methods described herein, these wagers can be tracked in the electronic database (using the player's identification ascertained from the electronic card reader at the table).

Any embodiments described herein can be played with a standard deck of cards or any type of special deck (e.g. a Spanish deck, etc.) The game can also be played with a single deck (in embodiments which do not allow for identical cards such as payouts for a suited pair) or multiple decks (e.g. 1-8 decks or more). Cards can be dealt in any order. Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement a wagering game, the method comprising:

executing the following instructions on a microprocessor, the microprocessor connected to an electronic input device and an electronic output device, the instructions performing:

receiving an ante wager from a player;

dealing a player's hand to the player using two cards;

dealing to a dealer a dealer's initial hand comprising an up-card, a down-card, and a swap-card, wherein a down hand comprises the up-card and the down-card and a swap hand comprises the up-card and the swap-card;

determining a dealer's hand by using a higher ranking hand between the down hand and the swap hand; and resolving the ante wager based on a relationship between the player's hand and the dealer's hand.

2. The method as recited in claim 1, further comprising, after the dealing the dealer's initial hand, receiving a decision by the player whether to raise or fold, wherein to raise requires the player to place a raise wager, wherein to fold results in the player losing the ante wager.

3. The method as recited in claim 2, wherein if the player raises, then if the player's hand is of at least a predetermined rank, then the player wins a payout on the ante wager and the raise wager.

4. The method as recited in claim 3, wherein the predetermined rank is a pair.

5. The method as recited in claim 1, further comprising, before the dealing the player's hand, receiving a side wager, wherein the side wager is resolved based on a ranking of the player's hand.

6. The method as recited in claim 1, further comprising, before the dealing the player's hand, receiving a side wager, wherein the side wager is resolved based on a ranking of the player's hand and a relationship between the player's hand and the dealer's hand.

7. The method as recited in claim 1, further comprising, before the dealing the player's hand, receiving a side wager, wherein if the player's hand ranks higher than the dealer's hand then the side wager pays only if the player's hand is one of a first predetermined set of ranks, and if the player's hand does not rank higher than the dealer's hand then the side wager pays only if the player's hand is one of a second predetermined set of ranks.

8. The method as recited in claim 7, wherein the first predetermined set of ranks comprises a straight and flush.

9. The method as recited in claim 7, wherein the second predetermined set of ranks comprises a paired flush and a straight flush.

10. An electronic gaming apparatus to implement a wagering game, the apparatus comprising:

an electronic input device and an electronic output device;

a microprocessor configured to operate with the input device and the output device, the microprocessor configured to execute instructions to perform a following operations:

receiving an ante wager from a player;

dealing a player's hand to the player using two cards;

dealing to a dealer a dealer's initial hand comprising an up-card, a down-card, and a swap-card, wherein a down hand comprises the up-card and the down-card and a swap hand comprises the up-card and the swap-card;

determining a dealer's hand by using a higher ranking hand between the down hand and the swap hand; and resolving the ante wager based on a relationship between the player's hand and the dealer's hand.

11. The apparatus as recited in claim 10, further comprising, after the dealing the dealer's initial hand, receiving a decision by the player whether to raise or fold, wherein to raise requires the player to place a raise wager, wherein to fold results in the player losing the ante wager.

12. The apparatus as recited in claim 11, wherein if the player raises, then if the player's hand is of at least a predetermined rank, then the player wins a payout on the ante wager and the raise wager.

13. The apparatus as recited in claim 12, wherein the predetermined rank is a pair.

14. The apparatus as recited in claim 10, further comprising, before the dealing the player's hand, receiving a side wager, wherein the side wager is resolved based on a ranking of the player's hand.

15. The apparatus as recited in claim 10, further comprising, before the dealing the player's hand, receiving a side wager, wherein the side wager is resolved based on a ranking of the player's hand and a relationship between the player's hand and the dealer's hand.

16. The apparatus as recited in claim 10, further comprising, before the dealing the player's hand, receiving a side wager, wherein if the player's hand ranks higher than the dealer's hand then the side wager pays only if the player's hand is one of a first predetermined set of ranks, and if the player's hand does not rank higher than the dealer's hand then the side wager pays only if the player's hand is one of a second predetermined set of ranks.

17. The apparatus as recited in claim 16, wherein the first predetermined set of ranks comprises a straight and flush.

18. The apparatus as recited in claim 16, wherein the second predetermined set of ranks comprises a paired flush and a straight flush.

* * * * *